US005278474A

United States Patent [19]

Nieda

[11] Patent Number: 5,278,474

[45] Date of Patent: Jan. 11, 1994

[54] DISCHARGE TUBE

[75] Inventor: Yoriyuki Nieda, Kamakura, Japan

[73] Assignee: Tokyo Densoku Kabushiki Kaisha, Kanagawa, Japan

[21] Appl. No.: 2,086

[22] Filed: Jan. 8, 1993

Related U.S. Application Data

[63] Continuation of Ser. No. 807,429, Dec. 13, 1991, abandoned, which is a continuation of Ser. No. 460,319, Jan. 3, 1990, abandoned.

[30] Foreign Application Priority Data

Jan. 12, 1989 [JP] Japan ..... 1-005753

[51] Int. Cl.[5] ..... H01J 17/04; H01J 61/06

[52] U.S. Cl. ..... 313/631; 313/628; 313/601

[58] Field of Search ..... 313/631, 622, 602, 492, 313/601, 628

[56] References Cited

U.S. PATENT DOCUMENTS

| | | | |
|---|---|---|---|
| 2,046,941 | 7/1936 | Gaidies . | |
| 2,187,774 | 1/1940 | Francis | 313/601 |
| 2,314,134 | 3/1943 | Eknayan . | |
| 2,364,889 | 12/1944 | Blair | 313/631 X |
| 2,562,887 | 8/1951 | Beese | 313/628 X |
| 3,548,242 | 12/1970 | Ayotte et al. | 313/601 |
| 3,670,195 | 6/1972 | Kamegaya . | |
| 4,968,916 | 11/1990 | Davenport et al. . | |

FOREIGN PATENT DOCUMENTS

| | | | |
|---|---|---|---|
| 0080551 | 6/1983 | European Pat. Off. . | |
| 0101948 | 3/1984 | European Pat. Off. . | |
| 0213927 | 3/1987 | European Pat. Off. . | |
| 0313271 | 4/1989 | European Pat. Off. . | |
| 0323945 | 7/1989 | European Pat. Off. . | |
| 0333629 | 9/1989 | European Pat. Off. . | |
| 319769 | 4/1957 | Fed. Rep. of Germany . | |
| 3036746 | 4/1981 | Fed. Rep. of Germany . | |
| 61756 | 5/1981 | Japan | 313/493 |
| 56-147355 | 11/1981 | Japan . | |
| 18863 | 2/1983 | Japan | 313/622 |
| WO870456 | 7/1987 | PCT Int'l Appl. . | |
| 482012 | 3/1938 | United Kingdom | 313/601 |
| 491176 | 9/1938 | United Kingdom . | |
| 486138 | 5/1939 | United Kingdom . | |
| 2126415 | 3/1984 | United Kingdom . | |

OTHER PUBLICATIONS

Patent Abstracts of Japan, vol. 6, No. 123 (E-117), Jul. 8, 1982, p. 1001, & JP-A-57 50 760 (Matsushita).

International Search Report for International Patent Application Serial No. PCT/US91/03233 (see attached Search Report).

*Primary Examiner*—Sandra L. O'Shea

*Attorney, Agent, or Firm*—Ladas & Parry

[57] ABSTRACT

A discharge tube having a pair of opposite electrode assemblies disposed in a discharge space defined by a peripheral wall and charged with gas, and an a.c. source connected at one end to one of the pair of electrode assemblies and at the other end to the other of the electrode assemblies, each of said opposite electrode assemblies comprising a sintered metallic electrode for emitting electrons and a filament electrode disposed closely adjacent to the sintered metallic electrode, for emitting thermoelectrons, and the sintered metallic electrode and the filament electrode being electrically connected in parallel by means of the associated lead wires.

12 Claims, 5 Drawing Sheets

DISCHARGE TUBE

This is a continuation of copending application Ser. No. 07/807,429 filed on Dec. 13, 1991, now abandoned, which is a continuation of application Ser. No. 07/460,319 filed Jan. 3, 1990, now abandoned.

BACKGROUND OF THE INVENTION

1. Field of the Invention

The present invention relates to a discharge tube having a positive glow discharge characteristic in which the tube voltage increases as the discharge current increases and a negative arc discharge characteristic in which the tube voltage decreases as the discharge current increases due to an increase in emission of thermo-electrons.

2. Description of the Related Art

It is known that cold-cathode tubes, hot-cathode tubes and semi-hot cathode tubes are used in discharge-tube applications.

Cold-cathode tubes have positive discharge characteristics and have the advantages of long life, low power consumption, low heat dissipation, and the ability to be easily lit and quenched. The disadvantage of cold-cathode tubes is their low intensity. Hot-cathode tubes, which are known as fluorescent lamps, have negative thermionic discharge characteristics and the advantage of high intensity. Hot-cathode tubes, however, have the disadvantages of short life, high power consumption, high heat dissipation, and cannot be lit and quenched in themselves. Semi-hot-cathode tubes are arranged such that no filament electrode is energized by external circuits and have the disadvantage that a relatively long time is required to reach the desired intensity after energization. Also, semi-hot-cathode tubes are impractical in terms of life and intensity.

In Japanese Patent Application No. 63-172761, the present inventor proposes a discharge tube of the type having a discharge characteristic in which the negative discharge characteristic of a cold-cathode tube is combined with the positive discharge characteristic of a hot-cathode tube. More specifically, the proposed discharge tube comprises a pair of electrode assemblies which are disposed opposite to each other in a discharge space. Each of the electrode assemblies includes a cup-shaped electrode for glow discharge and, a filament electrode for arc discharge which is disposed in the cup-shaped electrode. This arrangement is intended to achieve a long life with glow discharges and very high brightness with arc discharges. However, it is necessary that such discharge tube be provided with an automatic control circuit for controlling discharge current in order to stably maintain the state of discharge. In this proposed type of discharge tube, several hours after energization the temperature of the cup-shaped electrode for glow discharge increases due to emission of thermoelectrons and a transition from glow discharge to arc discharge occurs. As a result, a phenomenon such as snaking or flickering takes place and the discharge becomes unstable. For this reason, the above electronic control circuit is used to control discharge current. However, the cost of the discharge tube becomes expensive due to the necessity of such control circuit and, even with this control circuit, it is still difficult to perfectly eliminate flickers of high frequency.

SUMMARY OF THE INVENTION

It is therefore a primary object of the present invention to provide a discharge tube in which the above-described problems can be solved.

It is a specific object of the present invention to provide a high-intensity long-life discharge tube which has the functions of both arc discharge and glow discharge and in which a transition from glow discharge to arc discharge is not caused by a rise in the temperature of an electrode for glow discharge.

To achieve the above objects, in accordance with the present invention, there is provided a discharge tube in which a pair of opposite electrode assemblies are disposed in a gas-charged discharge space which is, at least in part, defined by a glass wall. In the discharge tube, each of the electrode assemblies is provided with a sintered metallic electrode for emitting electrons and a filament electrode coated with oxide for emission of thermoelectrons, and the sintered metallic electrode and the filament electrode are arranged close to each other and electrically connected in parallel.

Each of the opposite electrode assemblies, which are arranged at both ends of the discharge space, includes an electrode for glow discharge and an electrode for arc discharge, which are arranged side by side. Accordingly, when a voltage from the same high-frequency electric source is applied to these electrodes, high-intensity arc discharge and glow discharge are stably formed in the discharge space at the same time, whereby a very high intensity of 35,000 Nt or more is obtained by the synergistic effect of the arc discharge and the glow discharge. The unit Nt is cd/m$^3$, where cd is candela and m is meters. For instance, if metal, such as nickel, is used for electrodes for glow discharge, stable glow discharge will be obtained up to a current level of about 3 mA. However, in general, at current levels of 4 mA or more the discharge characteristic of the electrodes for glow discharge enters an arc-discharge region where glow discharge does not stabilize. In contrast, the above-described arrangement according to the present invention makes it possible to provide stable glow discharge even when the current increases, and an intensity of 10,000 Nt can be achieved with glow discharge alone.

BRIEF DESCRIPTION OF THE DRAWINGS

The present invention will be hereinbelow described in preferred embodiment forms with reference to the accompanying drawings, in which.

DESCRIPTION OF THE PREFERRED EMBODIMENTS

Preferred embodiment of the present invention will be explained below with reference to the accompanying drawings.

Figure 1:
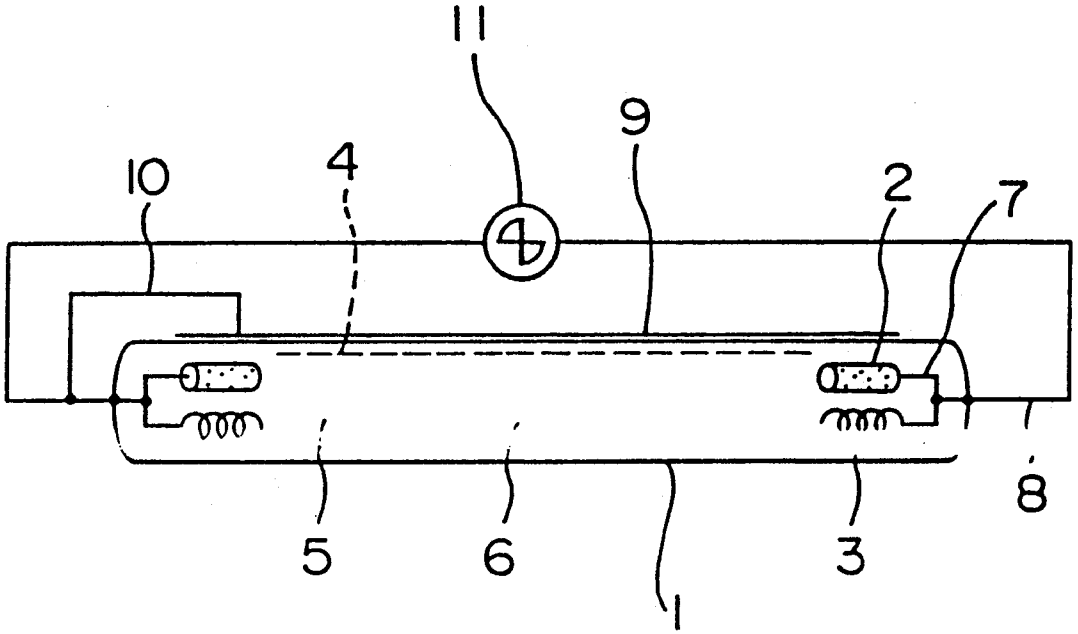
FIG. 1 is a diagrammatic view showing a first embodiment of the present invention.

FIG. 1 shows a first embodiment of a discharge tube according to the present invention. As illustrated, a rod-like sintered electrode 2 and a filament coil electrode 3 are disposed at each end of a transparent glass tube 1 which has a diameter of approximately 6 mm and a length of approximately 260 mm. At each end, the rod-like sintered electrode 2 and the filament coil electrode 3 are arranged in parallel and close to each other, i.e., in a non-contact state. Each of the rod-like electrodes 2 has a diameter of 2 mm and a length of 6 mm and is prepared by mixing tungsten powder, zirconium, nickel and barium carbonate, forming the mixture with a press, and sintering the formed mixture. Each of the filament coil electrodes 3 has a good electron emission characteristic and is prepared by coating a solution of barium hydroxide over the peripheral surface of a tungsten wire, sintering the tungsten wire to form a coat of barium carbonate, and forming it into a coil. In the glass tube 1, each of these electrodes 2 and 3 is supported by a tungsten wire or rod-like member 7 and connected to one end of a lead wire 8 via the tungsten rod-like member 7. One end of each of the lead wires 8 extends into the glass tube 1 through a glass end wall thereof. The inner surface of the glass tube 1 is coated with a fluorescent film 4 and the interior of the glass tube 1 is charged with argon gas 6 pressurized at a pressure of 30 torr and containing 5 mg of mercury.

A strip or trigger coating 9 is formed on the outer surface of the glass tube 1 to extend along the length thereof. A lead wire 10 is led from the trigger coating 9 and connected to the lead wire 8 which is led from one end of the glass tube 1. The other ends of the respective lead wires 8 are connected to an A.C. power source 11.

Figure 2:
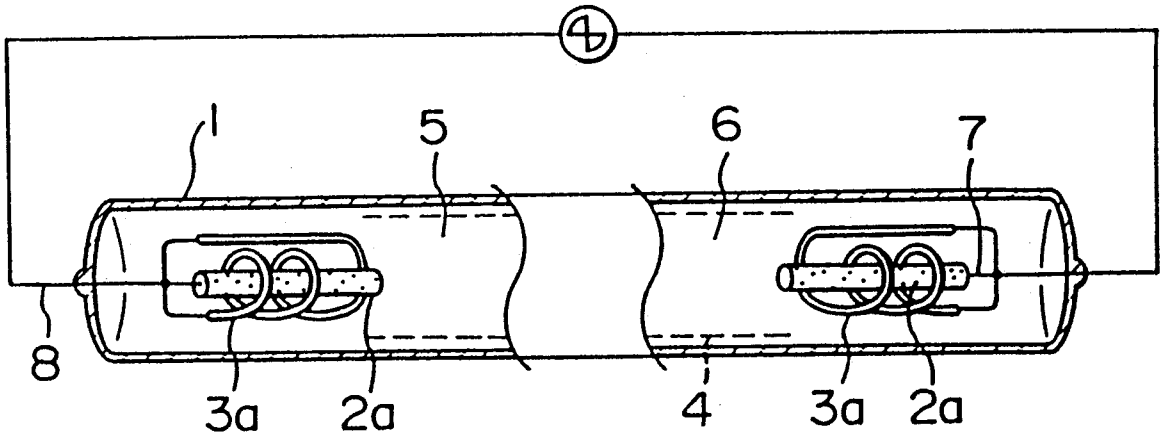
FIGS. 2–4 diagrammatic views which show modifications of the first embodiment of the present invention, respectively, with FIGS. 3 and 4 showing modified portions only.

FIG. 2 shows a discharge tube according to one modification of the first embodiment shown in FIG. 1. In FIG. 2, the same reference numerals are used to denote the same elements as those shown in FIG. 1. This modification differs from the first embodiment in that each filament coil electrode 3*a* is arranged to surround a corresponding rod-like sintered electrode 2*a* in a non-contact state.

For example, if a sine wave of oscillation frequency 40 kHz and effective voltage 1,500 V is applied to the lead wires 8 at both ends of the discharge tube, a highly stable discharge can be achieved with a discharge current of 20 mA and an intensity of 35,000 Nt. The temperature of the tube wall of the portion of the discharge tube which is adjacent to each electrode assembly is approximately 15 degrees higher than room temperature and the amount of heat generated can be reduced compared to conventional arrangements. Accordingly, it is possible to reduce power consumption. In addition, since no control circuit for stabilizing discharge is needed, a discharge-tube driving circuit can be made compact.

Figure 3:
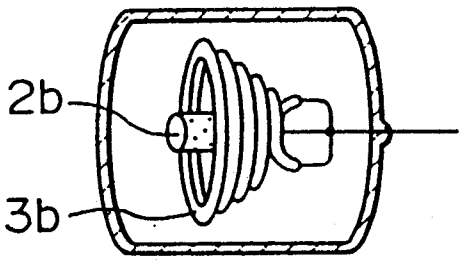

FIG. 3 shows another modification of the first embodiment, and only an electrode assembly which differs from that shown in FIG. 2 is illustrated. This modification is similar to the modification of FIG. 2 in that a rod-like sintered electrode 2*b* is surrounded by a filament coil electrode 3*b*, but the filament coil electrode 3*b* is densely coiled in cup-like form with each of its ring segments held in close contact with the adjacent ring segment.

Figure 4:
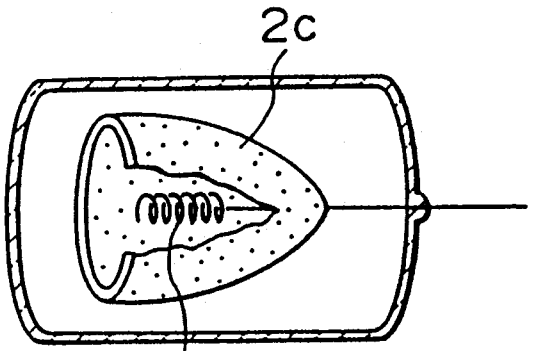

FIG. 4 shows still another modification of the first embodiment, and an electrode assembly which differs from that shown in FIG. 3 is illustrated. In the illustrated assembly, a sintered metallic electrode 2*c* for glow discharge is formed into a cup-like shape, and a filament coil electrode 3*c* for arc discharge extends straight along the axis of the assembly. The cup-like electrode 2*c* may be formed into the shape of a hollow cylinder with a bottom.

It is desirable that any of the discharge tubes according to the first embodiment have a glass-tube diameter of about 4 mm to about 10 mm.

Instead of the sintered electrode shown in FIG. 4, there can be used an electrode formed so that a nickel or tungsten wire is densely coiled in a shape similar to that of the electrode 3*b* shown in FIG. 3 while coating a nickel or tungsten powder over the peripheral surface of the coiled wire. Further, then the filament coil electrode 3*c* is set at the center of the thus-formed electrode.

EXAMPLE 1

A sine-wave oscillating voltage was applied across the discharge tube shown in FIG. 2 under the following conditions:

charged gas: a mixed gas containing argon gas of 50 torr and 5 mg of mercury;
oscillation frequency: 40 kHz; and
ambient temperature: room temperature (15° C.)

Figure 5:
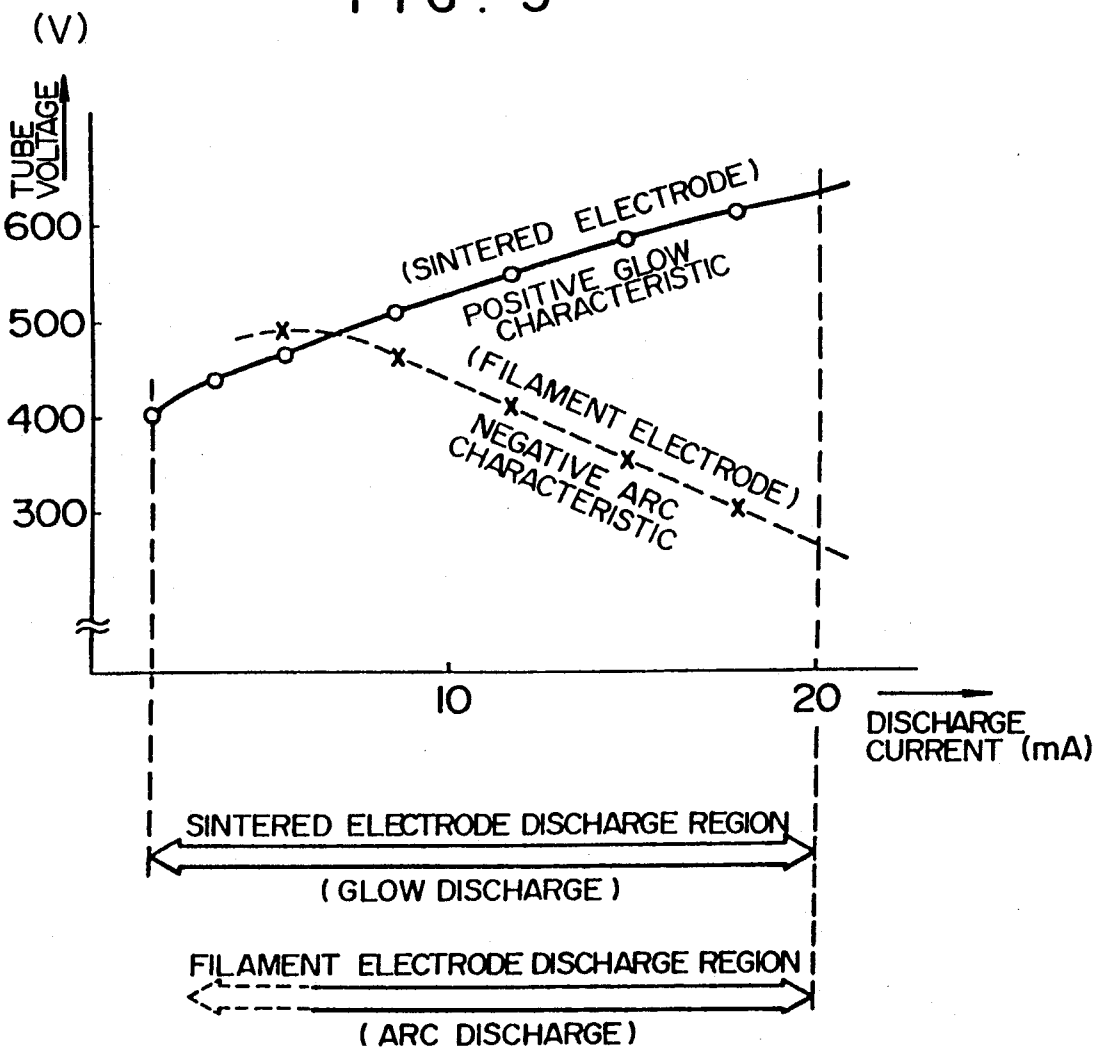
FIG. 5 is a graph which serves to illustrate the advantage of the present invention.

The relationship between voltage (V) and discharge current (mA), shown in FIG. 5, was obtained by gradually raising the voltage (V) from 0 V.

As is apparent from FIG. 5, glow discharge was started between the opposite sintered electrodes at 400 Vrms, and the filament coil electrodes started discharges at approximately 500 Vrms. Even if the voltage was raised to 500 Vrms or more, a positive discharge characteristic was maintained between the sintered electrodes. In other words, it was proved that the glow discharge could be maintained even at a voltage level of 500 Vrms or more. In addition, it was proved that, at a voltage level of 500 Vrms or more, a negative discharge characteristic could be obtained between the filament coil electrodes, whereby arc discharge could be maintained.

As is apparent from the foregoing, since the two kinds of discharge, glow discharge and arc discharge, are realized within a single discharge tube, very high intensity of illumination can be achieved. Also, since the filament coil electrodes are heated by glow discharge, arc discharge can be generated by using a relatively low voltage. In addition, since the two kinds of electrodes are arranged in a non-contact state, the sintered metallic electrodes are not heated by the heat generated in the adjacent filament coil electrodes. Accordingly, since no thermorunway takes place in the sintered metallic electrodes, glow discharge does not proceed with arc discharge and the glow discharge can be kept highly stable between the sintered metallic electrodes.

Each of the filament coil electrodes is coated with an active oxide such as barium, strontium or the like in order to accelerate emission of thermoelectrons Accordingly, particles may be scattered due to evaporation or peeling caused by ion bombardment or heating and fall on the inner tube wall of the discharge tube, thereby causing the shading phenomenon in which dark shades are formed on the inner tube wall of the discharge tube. However, if the cup-shaped sintered metallic electrode shown in FIG. 4 is employed, scattered particles stick to the inner wall of the cup-shaped sintered metallic electrode and the stuck particles or active oxide can be reused. In addition, since it is possible to prevent the shading phenomenon by suppressing the phenomenon in which scattered particles stick to the inner tube wall of the discharge tube, the lifetime of the discharge tube can be improved. The present inventor conducted a lifetime test with a discharge tube having such electrode assemblies, and the shading phenomenon was not substantially observed even after running of 10,000 hours or thereabouts.

Figure 6:
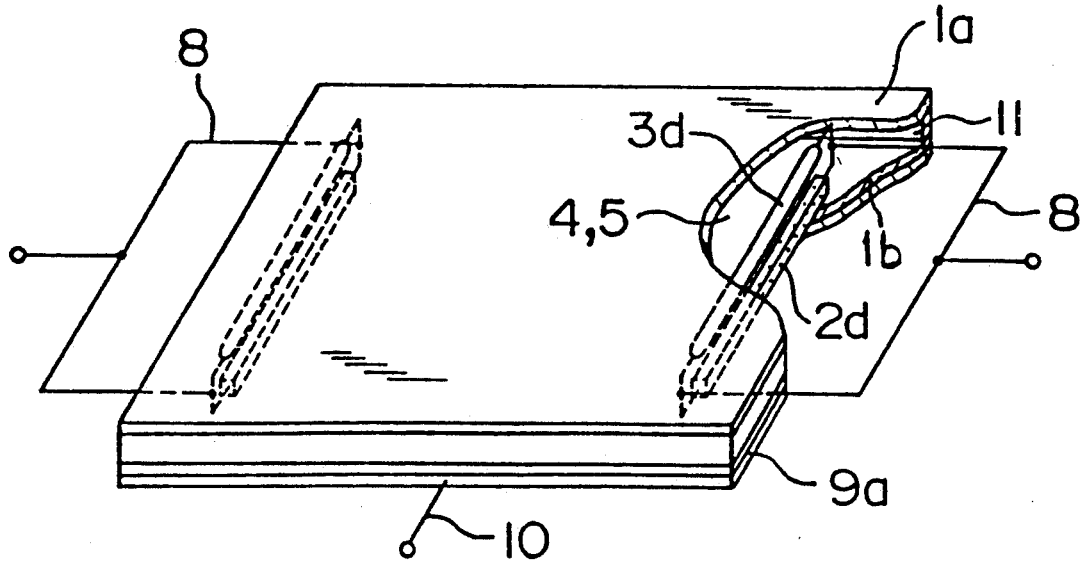
FIG. 6 is a diagrammatic perspective view showing a second embodiment of the present invention.

FIG. 6 shows a second embodiment of the present invention. As the second embodiment, there is shown a discharge tube which is made from a flat discharge plate configured like a flat box.

The illustrated discharge plate includes a top glass plate 1*a*, a bottom glass plate 1*b* and a glass frame spacer 11. Each of the glass plates 1*a* and 1*b* has one surface coated with a fluorescent film, and the glass plates 1*a* and 1*d* are stacked one upon another with their coated surfaces facing each other. The glass frame spacer 11 is sandwiched between the top and bottom glass plates 1*a* and 1*b*. The glass plates 1*a* and 1*b* and the glass frame spacer 11 are bonded by glass solder, thereby forming a discharge space. The discharge space is charged with discharge gas consisting of a mixture of argon gas 5 pressurized at several tens of torr and several milligrams of mercury 4. A rod-shaped sintered metallic electrode 2*d* and a filament coil electrode 3*d* are arranged in parallel and close to each other at each end of the discharge space. The filament coil element 3*d* is formed into a rod-like configuration in which a tungsten coil, coated with oxide metal having good electron-emission characteristics, is densely coiled. A trigger conductive plate or film 9*a* is bonded to the external surface of the bottom glass plate 1*b*.

The discharge plate having the above construction also exhibits characteristics similar to those of the discharge tube shown in FIG. 2. More specifically, with the above second embodiment, it is possible to provide a surface light source having the following advantages: glow discharge and arc discharge can coexist so that very high intensity, long life and low power consumption can be achieved; lighting and quenching are easy; the amount of heat generated is small; and highly stable operation is assured.

Figure 7:
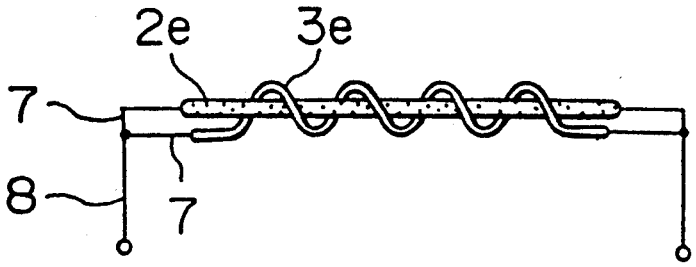
FIGS. 7–8 are partial perspective views showing modifications of the second embodiment of the present invention, respectively.

FIG. 7 shows a modification of the second embodiment of FIG. 6, and only an electrode assembly which differs from that used in the above second embodiment is illustrated. The illustrated electrode assembly is arranged in such a manner that a filament coil electrode 3*e* for arc discharge is wound around the periphery of a sintered electrode 2*e* for glow discharge in a non-contact state.

Figure 8:
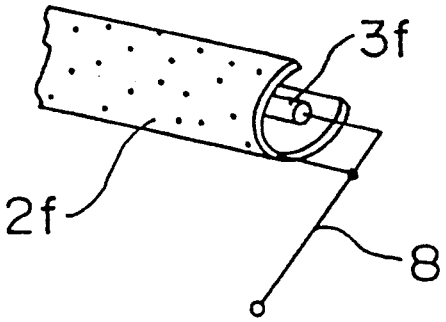

FIG. 8 shows another modification of the second embodiment, and a tungsten wire electrode 3*f* for arc discharge is disposed along the axis of a hemicylindrical sintered electrode 2*f*. This modification also makes it possible to achieve advantages similar to those of the discharge tube shown in FIG. 4.

Figure 9:
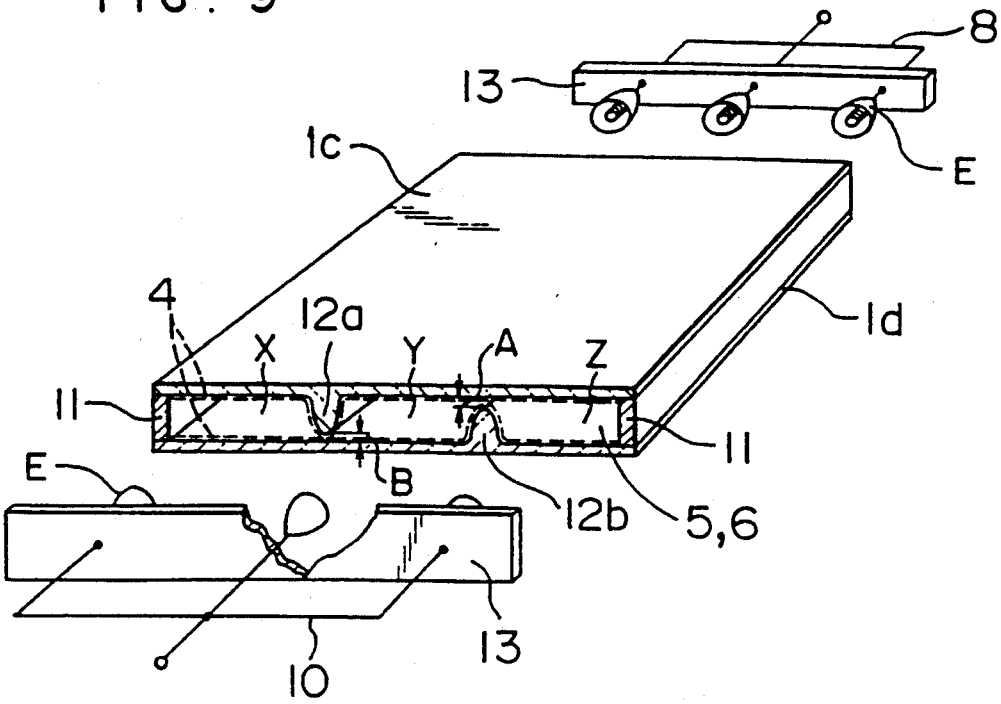
FIG. 9 is a diagrammatic perspective view showing a third embodiment of the present invention.

FIG. 9 shows a third embodiment of the discharge tube of the present invention. The third embodiment is substantially the same as the embodiment of FIG. 6 except that a top glass plate 1*c* and a bottom glass plate 1*d* have ribs 12*a* and 12*b* formed on their facing surface, respectively. It has been explained that the above second embodiment makes it possible to obtain a postcard-size surface light source made from a glass plate with a plate thickness of approximately 4 mm. However, if the size is further increased, the thickness of the glass plate also increases to an impractical extent. However, if the ribs 12*a* and 12*b* are formed as in the second embodiment, the strength of each of the top and bottom glass plates 1*c* and 1*d* can be increased to a considerable extent. Accordingly, a surface light source having a light weight and a considerably large size can be obtained.

If the gaps A and B between the tips of the ribs 12*a* and 12*b* and the inner surfaces of the opposing glass plates are respectively selected to be approximately 0.5 mm to 0.1 mm, the discharge impedance in each of the gaps A and B becomes high and the discharge space is substantially divided into a plurality of small discharge spaces X, Y and Z. Electrode assemblies E, each of which is similar to that shown in FIG. 4, are respectively arranged at the opposite ends of each of the small discharge spaces X, Y and Z, whereby a discharge plate is obtained which is constructed as if a plurality of discharge tubes were arranged side by side. In this arrangement, arc discharge is reliably produced in each of the small discharge spaces, whereby it is possible to prevent the phenomenon in which arc discharges are concentrated upon a specific one of the opposite electrodes (this phenomenon easily occurs at a temperature of chiefly 5° C. or less). Further, since the inner surfaces of the glass plates including the ribs 12*a* and 12*b* are coated with the fluorescent film, the surface portions of the glass plates corresponding to the respective ribs are not darkened. In addition, since the area occupied by the fluorescent surface increases owing to the formation of the ribs, the total intensity of the surface light source rises. In FIG. 9, reference numeral 13 denotes an end plate made of glass, and the lead wires 8 extend through the end plates 13 to hold the corresponding electrode assemblies E.

Figure 10:
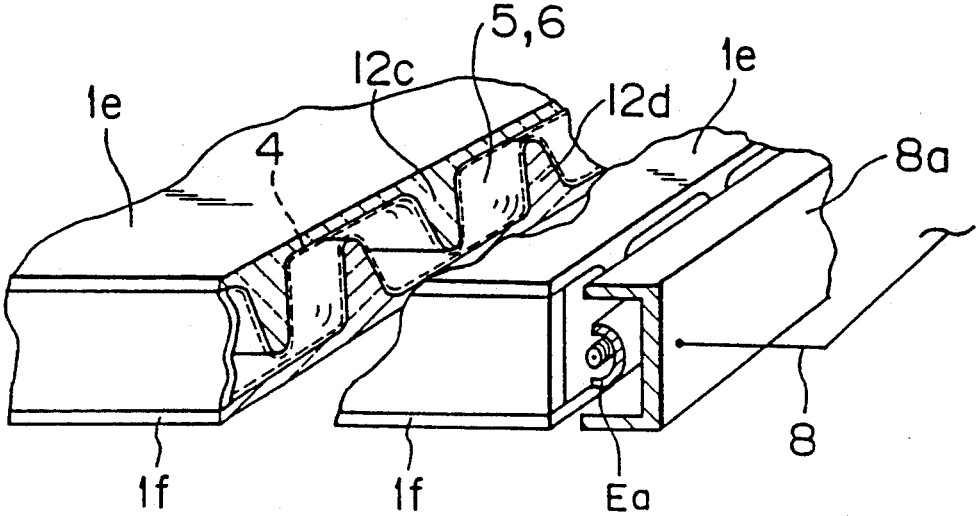
FIG. 10 is a diagrammatic perspective view showing a modification of the third embodiment of the present invention.

FIG. 10 shows a modification of the third embodiment, wherein ribs 12*c* and 12*d* are densely formed on glass plates 1*e* and 1*f*, respectively. In this arrangement, electrode assemblies Ea, each of which is similar to that shown in FIG. 8, are disposed and a multiplicity of electrode assembly pairs are arranged in small discharge spaces, respectively. Each of the end plates has a trough-like configuration so as to accommodate the electrode assemblies Ea. This arrangement also makes it possible to provide a discharge characteristic similar to that of the discharge plate of FIG. 9.

Preferably, sintered metal is used for the electrodes for glow discharge. Although intensity is somewhat low, nickel may also be used.

As is apparent from the foregoing, since the filament coil electrodes are heated by glow discharge, emission of thermoelectrons is accelerated and rapid lighting (several tens of seconds) is enabled.

Since active oxide can be reused and the shading phenomenon can be suppressed, a lifetime as long as 20,000 hours can be achieved.

Since glow discharge and arc discharge coexist, a very high intensity of 35,000 Nt or thereabouts can be realized.

Since the electrodes for arc discharge can be heated by the respective electrode assemblies themselves, no external preheating device is needed and power consumption can be reduced to a considerable extent. In addition, the amount of heat generated can be reduced.

The electrodes for glow discharge are not forced into a state of arc discharge and stable discharge can therefore be achieved.

What we claim is:

1. In a discharge tube including a plurality of discharge spaces charged with gas, defined by a peripheral wall having at least one part formed of glass, and sectioned by longitudinally extending ribs integrally formed on said peripheral wall, a plurality of pairs of opposite electrode assemblies, each of said pairs being disposed in each of said discharge spaces, and an a.c. power source connected at one end to one of each pair of said opposite electrode assemblies and at the other end connected to the other of each pair of said opposite electrode assemblies through the intermediary of lead wires, an improvement wherein said each of said opposite electrode assemblies comprises:

a glow discharge electrode, and an arc discharge electrode arranged closely adjacent to but spaced from said glow discharge electrode and coated with oxide, for emitting thermoelectrons whereby said glow discharge electrode and said arc discharge electrode of one of each of said pairs of opposite electrode assemblies are opposed respectively to the glow discharge electrode and the arc discharge electrode of the other of each of said pairs of opposite electrode assemblies so as to effect a glow discharge and an arc discharge respectively therebetween.

2. A discharge tube as set forth in claim 1, wherein said flow discharge electrode is a rod-like sintered electrode while said arc discharge electrode is a coiled filament electrode surrounding said rod-like sintered electrode.

3. A discharge tube as set forth in claim 2, wherein said coiled filament electrode has a conical shape.

4. A discharge tube as set forth in claim 1, wherein said glow discharge electrode is a hemicylindrical sintered metallic electrode having a center axis while said arc discharge electrode is a coiled filament electrode laid along said center axis.

5. A discharge tube as set forth in claim 1, wherein said glow discharge electrode is a conical cup shaped sintered metallic electrode having a center axis while said arc discharge electrode is a coiled filament electrode dispose along said center axis.

6. A discharge tube comprising:

a peripheral wall defining a gas-charged space having a uniform cross-sectional shape throughout from one end to the other end thereof and made of glass at least in part;

a pair of first and second opposite electrode assemblies disposed in said gas-charged space, respectively, at both ends of the latter, each of said first and second opposite electrodes assemblies including a cup-shaped glow discharge electrode having a center axis and axially opposite open and closed ends, and an arc discharge electrode arranged along the center axis and spaced from said glow discharge electrode and coated thereover with a thermoelectron emitting material so that said glow discharge electrode and said arc discharge electrode of said first electrode assembly are opposed to the glow discharge electrode and the arc discharge electrode of said second electrode assembly, respectively, in order to effect a glow discharge and an arc discharge, respectively, between said glow discharge electrodes and between said arc discharge electrodes, each of said arc discharge electrodes having a distal end and a proximal end, said distal end being located substantially inward from said open end of the associated glow discharge electrode while said proximal end of said arc discharge electrode is supported to said closed end thereof in a condition such that vapors emitted from said thermoelectron emitting material are trapped substantially completely within said cup-shaped electrode; and a power source connected at one end to said first electrode assembly and the other end connected to said second electrode assembly, for applying a voltage between said first and second electrode assemblies;

wherein said cup-shaped glow discharge electrodes each has an outer surface area which is for dissipating heat directly into said gas-charged space for holding said glow discharge electrodes at a temperature at which said glow discharge can be stably held even during said arc discharge electrodes performing arc discharge.

7. A discharge tube as set forth in claim 6, wherein each said glow discharge electrode is a sintered metallic electrode, and each said arc discharge electrode is a coiled filament electrode.

8. A discharge tube as set forth in claim 7, wherein said sintered metallic electrode is a conical cup shape surrounding said filament electrode.

9. A discharge tube as set forth in claim 6, wherein said glow discharge electrodes are made of sintered metallic materials.

10. A discharge tube comprising:

a tubular member, including a tubular wall having opposite closed ends defining a gas charged space;

first and second electrode assemblies respectively disposed at said closed ends in said gas charged space;

means for applying a voltage to said first and second electrode assemblies;

each electrode assembly comprising a cup-shaped glow discharge electrode having a central axis and an arc discharge electrode extending along said axis, said cup-shaped glow discharge electrode having a closed end at which said voltage is applied and an open end facing the open end of the glow discharge electrode of the other electrode assembly, the arc discharge electrode of each electrode assembly including a coating of a thermoelectron emitting material, said electrode assemblies producing glow discharge between said glow discharge electrodes and arc discharge between said arc discharge electrodes;

said cup-shaped glow discharge electrodes having an outer surface directly facing and open to said tubular wall for dissipation of heat therefrom into said gas charged space; said cup-shaped glow discharge electrodes having an inner surface directly facing said arc discharge electrodes without direct contact therewith for trapping vapors produced by the coating of thermoelectron emitting material on the arc discharge electrode to provide temperature stabilization of said electrodes.

11. A discharge tube as claimed in claim 10, wherein said cup-shaped electrode has a curved generatrix.

12. A discharge tube as claimed in claim 11, wherein said outer surface of each cup-shaped electrode in entirety faces said tubular wall and said arc electrode has a free end disposed within the cup-shaped electrode and completely disconnected therefrom.

* * * * *